US006585224B1

(12) United States Patent
Schmidt

(10) Patent No.: US 6,585,224 B1
(45) Date of Patent: Jul. 1, 2003

(54) OUTBOARD MOTOR RACK SYSTEM AND RELATED METHOD OF USE

(75) Inventor: Jesse R. Schmidt, Ortonville, MI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/629,343

(22) Filed: Aug. 1, 2000

(51) Int. Cl.[7] ..... F16M 1/00; F16M 11/00

(52) U.S. Cl. ..... 248/640; 248/639; 248/346.01; 248/346.02; 248/176.1; 108/55.1; 108/57.17; 211/13.1

(58) Field of Search ..... 248/640, 639, 248/641, 678, 440.1, 346.01, 346.03, 346.02, 371, 373, 176.1; 108/55.1, 57.17, 57.31, 55.3, 55.5; 211/13.1

(56) References Cited

U.S. PATENT DOCUMENTS 1,118,208 A * 11/1914 Mclaren ..... 248/640
2,122,770 A * 7/1938 Colin ..... 211/13
2,266,683 A * 12/1941 Berglund ..... 248/195
2,380,017 A * 7/1945 Blicker ..... 312/146
2,646,237 A * 7/1953 Hinesman ..... 248/4
2,687,310 A * 8/1954 Goetz ..... 280/46
2,839,198 A * 6/1958 Lefevre ..... 211/41
3,177,001 A * 4/1965 Wolford ..... 280/47.24
3,473,764 A * 10/1969 Hopper ..... 248/4
3,507,415 A * 4/1970 Mankey ..... 214/621
3,567,164 A * 3/1971 Hakal ..... 248/4
3,620,388 A * 11/1971 Mansson ..... 214/10.5 R
4,013,256 A * 3/1977 Hill ..... 248/346
4,044,978 A * 8/1977 Williams ..... 248/13
4,392,627 A * 7/1983 Van Den Brock ..... 248/176
4,660,796 A * 4/1987 Garrec ..... 248/544
4,976,092 A * 12/1990 Shuert ..... 53/475
6,186,468 B1 * 2/2001 Schlegel ..... 248/678

* cited by examiner

*Primary Examiner*—Kimberly Wood
(74) *Attorney, Agent, or Firm*—Ziolkowski Patent Solutions Group, LLC

(57) ABSTRACT

A method for storing and/or transporting outboard marine motors utilizes a rack having a rigid, substantially planar, horizontal base with parallel horizontal channels for insertion of fork lift tines. The base supports a pair of upright opposing frames, each frame in turn supporting a respective motor mounting beam. Preferably the frames and base are made of metal, while the motor mounting beams comprise a plywood plank with a metal sheath. At least two outboard motors can be mounted to each beam. Then a forklift is used to lift a fully loaded rack and load it onto a trailer or other carrier vehicle. A multiplicity of loaded racks are transported to a shipping destination. At the shipping destination, the outboard motors are removed from the racks. The empty racks are then returned to the point of origin.

24 Claims, 3 Drawing Sheets

OUTBOARD MOTOR RACK SYSTEM AND RELATED METHOD OF USE

FIELD OF THE INVENTION

This invention relates to systems for storing and transporting outboard motors, and particularly to pallet and rack systems for storing and transporting outboard motors.

BACKGROUND OF THE INVENTION

Outboard motors for boats and other watercraft are generally packed into corrugated and wood-cleated boxes for storage and transportation from the point of manufacture to a destination, e.g., to a boat building facility or to a boat dealership. This method of packaging is time-consuming, expensive and takes up a great deal of space. In particular, unpacking the outboard motors at their destination involves much labor and the packaging materials are discarded after unpacking, both of which add to the cost of shipping motors.

While in the case of a boat dealer, it may be desirable to transport an outboard engine inside its own crate or package to facilitate storage at the boat dealership, this is not true for situations where the outboard engines need not be stored at the destination. For example, if an outboard engine is being shipped to a boat builder who will mount the engine to the boat upon its arrival, there is no need to provide means for protecting the outboard engine during storage. Similarly, if outboard engines are being shipped to a test facility, there is no need for the engines to be packaged or crated.

Accordingly, it is desirable to provide a system of storing and transporting outboard motors without crating which utilizes reusable components, is easy to practice and is economic with regard to cost and space requirements.

SUMMARY OF THE INVENTION

The present invention is directed to a rack for storing and transporting outboard motors or engines. In accordance with the preferred embodiment of the invention, an outboard motor rack has a substantially planar base which functions as a pallet by providing a rigid horizontal support structure with tunnels or channels for insertion of forklift arms or tines. The rack further comprises a pair of upright opposing frames secured to the base. Each frame supports a respective motor mounting beam designed to receive a respective plurality of outboard engines mounted thereto, e.g., by means of mountings used to attach outboard motors to boat transoms. Preferably the base and frames are made of metal, while the motor mounting beams can be made of metal, wood, fiberglass, plastic, or any other material having sufficient strength to bear the weight of the motors attached thereto. The preferred material for the motor mounting beams is a plywood beam with a metal L-shaped sheath. The use of plywood has the advantages of reduced cost and easy replacement.

The invention is further directed to a method for storing and/or transporting outboard marine motors utilizing a rigid rack having pairs of tunnels or channels for insertion of forklift tines. The base supports a pair of upright opposing frames, each frame in turn supporting a respective motor mounting beam. At least two outboard motors are mounted to each beam. Then a forklift is used to lift a fully loaded rack and load it onto a trailer or other carrier vehicle. A multiplicity of loaded racks are transported to a shipping destination. At the shipping destination, the outboard motors are removed from the racks. The empty racks are then returned to the point of origin.

DETAILED DESCRIPTION OF THE PREFERRED EMBODIMENTS

Figure 1:
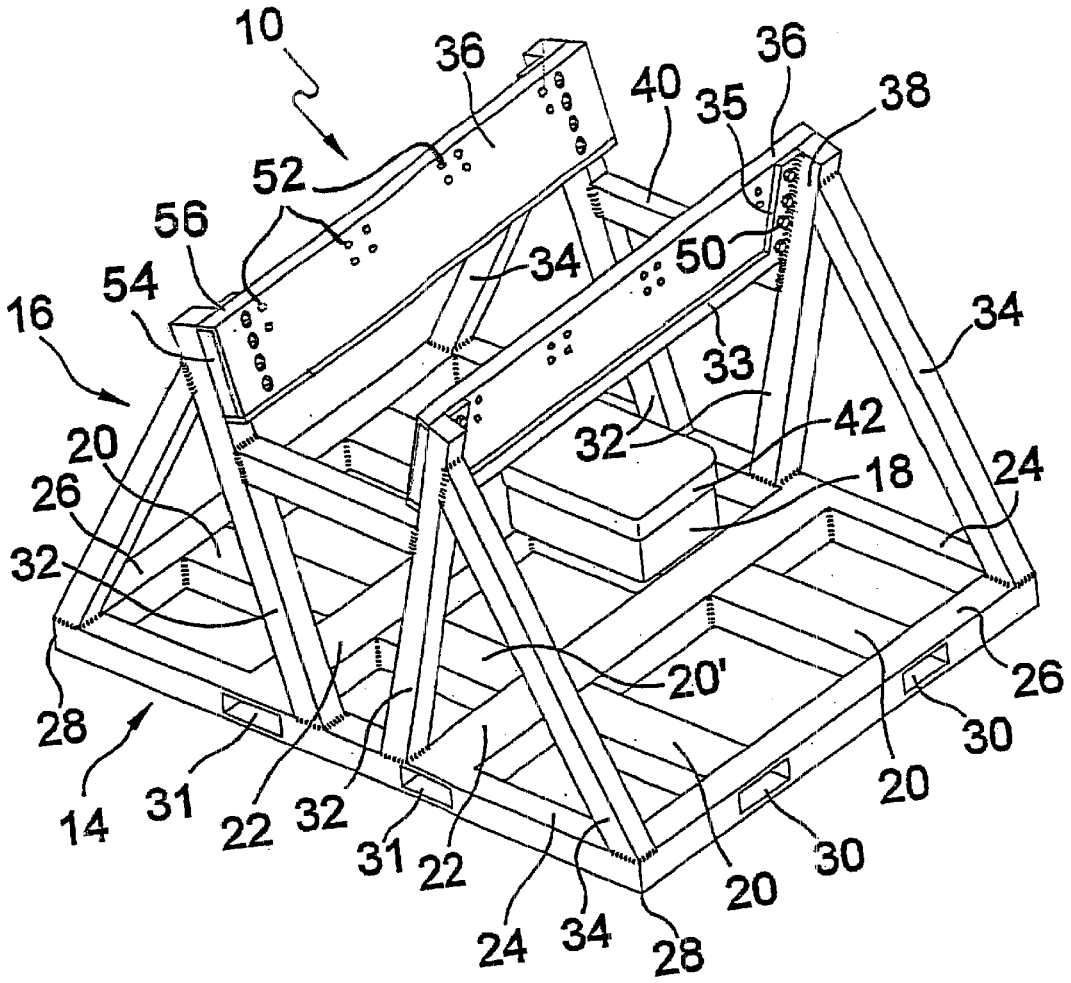
FIG. 1 is a perspective view of the outboard motor rack system in accordance with a preferred embodiment of the invention

Referring to FIG. 1, an outboard motor rack system 10 in accordance with the preferred embodiment of the invention comprises a substantially planar base pallet portion 14 which provides a rigid horizontal support structure. The rack is specifically designed to be lifted by a forklift having a pair of mutually parallel arms or tines at its front end. The base pallet portion 14 is provided with a first pair of channels 30 on one side and a second pair of channels 31 on another side. Although not visible in FIG. 1, the two opposing sides of the base pallet portion 14 respectively have third and fourth pairs of channels. The pair of channels 30 are mutually parallel. Likewise the pair of channels 31 are mutually parallel, but they are generally orthogonal to the pair of channels 30. The third pair of channels are parallel with the first pair of channels, while the fourth pair of channels are parallel with the second pair of channels. The channels for each pair are preferably separated by the same predetermined distance. The positions of the pair of tines at the front end of a forklift can be The channels for each pair are preferably separated by the same predetermined distance. The positions of the pair of tines at the front end of a forklift can be adjusted to be separated by the same predetermined distance. As a result, a forklift can access the rack from four mutually orthogonal directions. From each direction, the tines of the forklift can be fully inserted into a respective pair of channels and then the rack can be raised by the forklift and loaded onto a trailer, a train car or any other carrier vehicle.

In accordance with the preferred embodiment shown in FIG. 1, the rack system further comprises a pair of racks 16 supported on and extending upward from the base portion 14. Each rack 16 comprises a pair of A-frame structures on opposite sides, each A-frame structure comprising a post 32 and a brace 34. The posts 32 on opposite sides of each rack are connected by an angled cross member 33, which is welded to the posts. In addition, each post 32 has a mounting flange 35 with openings for fasteners 50. Each angled cross member 33 serves as a cradle for a respective motor mounting beam or plank 36, which is secured to the mounting flanges 35 on opposing sides of each rack by the aforementioned fasteners 50, which may comprise conventional nut and bolt assemblies. Preferably, the posts 32 of one rack are inclined at an angle of +15 to +25 degrees relative to a vertical plane, while the posts 32 of the other rack are inclined at an angle of −15 to −25 degrees relative to the same vertical plane. Since the plane of the motor mounting beams 36 is generally parallel to the associated posts 32, the beams 36 lie in the same range of angles.

FIG. 1 shows the motor mounting beams 36 fastened by four bolts 50 which penetrate four holes in the mounting flanges 35 and four holes in the beams 36. However, the elevation of the beams 36 can be increased, for mounting taller outboard motors, by removing the four bolts on each side, raising the beam 36 by an amount equal to the spacing between holes in the mounting flanges 35, and then fastening the lower three holes on each side of the beam 36 to the upper three holes on each mounting flange 35.

Figure 2:
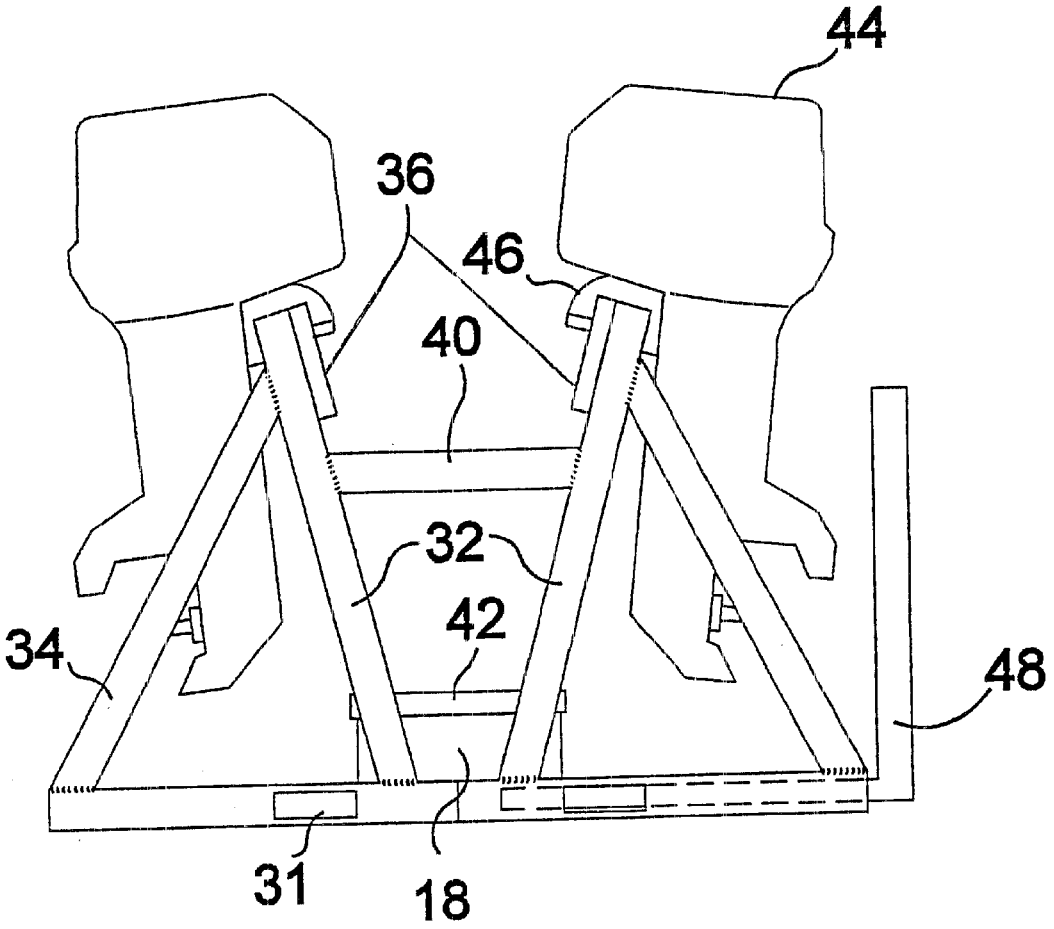
FIGS. 2 and 3 are side and front elevational views, respectively, of the outboard motor rack system in accordance with the preferred embodiment depicted in FIG. 1, with outboard motors (shown in profile) bolted or clamped to the rack for storage and/or transportation.
Figure 3:
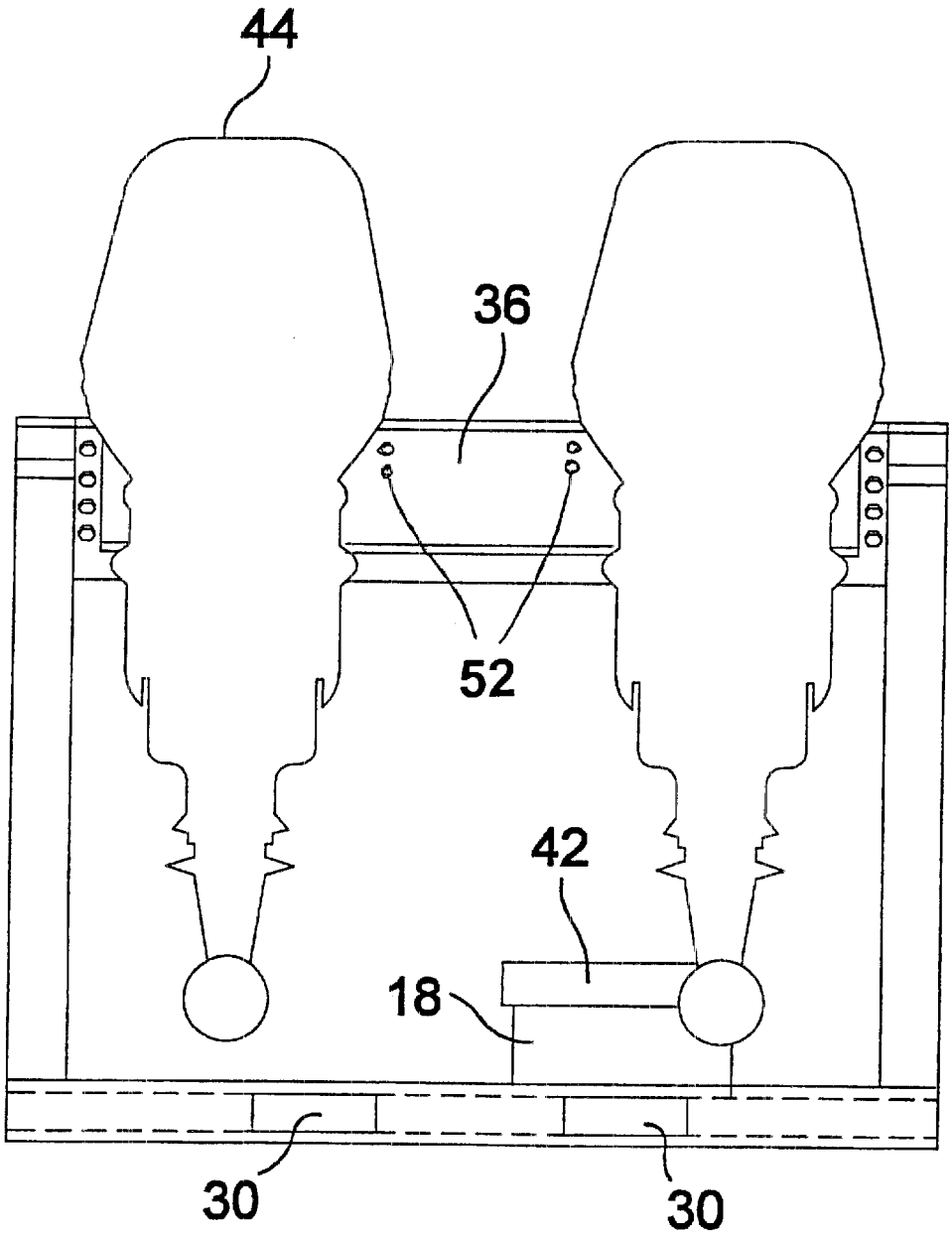

In accordance with the preferred embodiment of the invention, each beam 36 is designed to mimic the shape and dimensions of a boat transom, which allows a respective pair of outboard motors 44 to be mounted to each motor mounting beam 36, as illustrated in FIGS. 2 and 3, using conventional motor mountings 46 bolted to the motor mounting beams. Alternatively the motor can be clamped to the motor mounting beams.

In accordance with the preferred embodiment, each motor mounting beam 36 is constructed as a plywood plank 54 having an L-shaped metal sheath affixed to its top and inner surfaces. A multiplicity of pairs of throughholes 52 are provided in each motor mounting beam 36 for bolting the outboard motors to the beam. In the preferred embodiments, three sets of throughholes, each set comprising two spaced pairs of throughholes are provided in each beam: the sets on the left and right sides are used when two motors are to be mounted on a beam; the set in the middle is used when only one motor is to be mounted on a beam. The middle set of throughholes 52 can be seen in FIG. 3. Each throughhole 52 penetrates both the metal sheath 56 and the plywood plank 54.

A preferred embodiment of the present invention further comprises a parts storage container 18, including a removable lid 42, affixed to the top surface of the base portion 14. Container 18 is used to transport various small parts and/or accessories which are included with the outboard motors being transported.

Referring again to FIG. 1, the base portion 14 preferably comprises a multiplicity of lift tubes 20, 20' and 22 each having a rectangular cross section. These lift tubes are interconnected to form a network of communicating tunnels or channels for receiving the tines of a forklift via openings on four sides of the base portion 14. The lift tubes form a grid or lattice pattern having the general shape of a number symbol (#). Enclosing this grid pattern are a first pair of mutually parallel peripheral supports 24 and a second pair of mutually parallel peripheral supports 26 which form a rectangular periphery. The lattice of lift tubes lies inside this rectangular periphery, with the open ends of the lift tubes communicating with corresponding openings 30 and 31 formed in the exterior sidewalls of the peripheral supports. Preferably the interior sidewalls of the peripheral supports are also provided with openings which are penetrated by the respective lift tube 20 or 22. The peripheral supports 24, 26 are connected at right angles to form corners 28. Although the lattice of lift tubes can be constructed in many different ways, FIG. 1 depicts the case where a pair of mutually parallel transverse lift tubes 22 extend transversely between opposing peripheral supports 24; a first pair of mutually parallel longitudinal lift tubes 20 extend longitudinally between one transverse lift tube 22 and its nearest peripheral support 26; a second pair of mutually parallel longitudinal lift tubes 20 extend longitudinally between the other transverse lift tube 22 and its nearest peripheral support 26; and a third pair of mutually parallel longitudinal lift tubes 20' extend longitudinally between the transverse lift tubes 22. Preferably, two pairs of opposing openings are provided in the corresponding sidewalls of each transverse lift tube 22 at the locations where the longitudinal lift tubes intersect the transverse lift tubes, to allow the longitudinal lift tubes 20 and 20' to communicate and be penetrated by forklift tines.

The lift tubes 20, 20', 22 and the peripheral supports 24, 26 are preferably constructed of a rigid, durable high-strength material. In a particularly preferred embodiment of the invention, the lift tubes 20, 22 are made from tubular steel having a generally rectangular cross section. The peripheral supports may also be constructed from tubular steel, having a square or rectangular cross section. The lift tubes and peripheral supports may be assembled together by conventional means, for example, by welding of the tubular steel. Such construction allows for a combination of strength and rigidity with a relatively light weight, while allowing penetration of the structural members by the tines of a forklift. It can be readily appreciated that the base portion 14 can be assembled in other ways. For example, the periphery of the base could be formed by connected the ends of adjacent lift tubes with straight peripheral support members between the ends of parallel lift tubes and right-angled peripheral support members at the corners. In other words, each side of the base periphery may comprise a welded assembly of members as opposed to a single unitary member.

As previously mentioned, a pair of racks 16 are connected to the base 14, preferably by welding. Each rack 16 comprises a pair of A-frame structures on opposite sides. Each A-frame structure in turn comprises a post 32 and a brace 34. The lower end of each post 32 is welded to a peripheral support 24 in the region lying between the channels 31. The lower end of each brace 34 is welded to a respective corner of the base portion periphery. An upper portion of each post is welded to and supported by the upper end of a respective brace 34, while opposing posts 32 are connected a respective cross member 40, as shown in FIG. 1. The cross members 40 need not be straight. For example, each cross member could have an A-shape. Preferably each side of the rack system, comprising a pair of posts 32 supported by a pair of braces 34, with the braces being connected by a cross member 40, and with the lower ends of the posts and braces being welded to a peripheral support 24, is a planar structure.

FIGS. 2 and 3 illustrate a preferred embodiment of the invention wherein outboard motors 44 have been affixed, by means of their standard mountings 46, to the motor mounting beams 36 of the rack system 10. It can be readily appreciated that the outboard motor rack system in accordance with the preferred embodiments can carry at least four outboard motors. A larger capacity is possible by extending the length of all transverse elements, including lift tubes 22, peripheral supports 26 and motor mounting beams 36, when fabricating the rack system.

Additionally, as is best seen in FIG. 2, the motor mounting beams or planks 36 are angled slightly beyond vertical, so that the motors, when mounted thereon, do not extend beyond the external envelope of the two pairs of peripheral supports 24, 26. This prevents the motors mounted thereon from contacting motors on adjacent motor rack systems when several rack systems are placed in close proximity, such as when they are loaded onto trucks for transporting. As shown in FIG. 2, a forklift can engage the rack system 10 from any one of four mutually orthogonal directions by inserting the forklift tines 48 into either the channels 30 which open at the back and front or channels 31 which open on the sides of the base portion. The geometry of the motor rack system protects the mounted motors 44 from being contacted by the front end of the fork lift or adjacent vertical surfaces. This allows for more efficient packing of outboard motors into trailers, with a standard truck trailer being able to accommodate up to nine motor rack systems, each holding four outboard motors, for a total of 36 motors in a single trailer.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. For example, channels could be used instead of tubes in the base of the rack for receiving the forklift tines. Also, instead of making the motor mounting beams of wood, metal (e.g., a hollow tube), fiberglass or plastic material could be used. Therefore it is intended that the invention not be limited to the particular embodiment disclosed as the best mode contemplated for carrying out this invention, but that the invention will include all embodiments falling within the scope of the appended claims.

As used in the claims, the term "plurality" means two or more, and the term "beam" includes solid or hollow beams, solid or hollow planks, and equivalent structures.

What is claimed is:

1. An outboard motor rack system comprising:

a base comprising a first pair of mutually parallel horizontal channels for receiving forklift tines;

first and second support frames connected to and extending upward from said base, each of said support frames comprising a respective pair of spaced A frames, said first support frame being situated on one side of a plane vertical to said base, and said second support frame being situated on the other side of said vertical plane; and first and second motor mounting members respectively supported by said first and second support frames at substantially the same elevation in generally parallel relationship to each other on opposite sides of said vertical plane, wherein said first and second motor mounting members are inclined relative to said vertical plane and diverge from each other in an upward direction.

2. The outboard motor rack system as recited in claim 1, wherein said first motor mounting member comprises a plank made of wood and a sheath made of metal.

3. The outboard motor rack system as recited in claim 1, wherein said first support frame comprises a pair of mounting flanges, further comprising a multiplicity of fasteners for attaching said first motor mounting member to said pair of mounting flanges.

4. An outboard motor rack system comprising:

a base comprising a first pair of mutually parallel horizontal channels for receiving forklift tines;

a support frame extending from said base;

a first motor mounting member supported by said support frame, said first member being suitably shaped to receive a plurality of outboard motors mounted thereto; and a lidded container affixed to said base.

5. An outboard motor rack system comprising:

a base comprising a first pair of mutually parallel horizontal channels for receiving forklift tines;

a support frame extending from said base;

a motor mounting member supported by said support frame; and a plurality of outboard motors mounted to said motor mounting member.

6. The outboard motor rack system as recited in claim 5, wherein said base further comprises a second pair of mutually parallel horizontal channels for receiving forklift tines.

7. The outboard motor rack system as recited in claim 6, wherein said first and second pairs of horizontal channels are generally mutually parallel.

8. The outboard motor rack system as recited in claim 6, wherein said first and second pairs of horizontal channels are generally mutually orthogonal.

9. The outboard,motor rack system as recited in claim 5, wherein said first pair of horizontal channels are generally parallel to a longitudinal axis of said first motor mounting member.

10. The outboard motor rack system as recited in claim 5, wherein said first pair of horizontal channels are generally orthogonal to a longitudinal axis of said first motor mounting member.

11. A system comprising:

first and second mutually parallel channels intersected by a horizontal plane;

a beam having a longitudinal axis extending generally parallel to said horizontal plane; and a rigid frame for fixedly supporting said first beam relative to said first and second channels, and said first and second channels relative to each other, said rigid frame comprising first and second A frames, said first A frame supporting one end of said beam and said second A frame supporting the other end of said beam, wherein said beam comprises a plank made of wood and a sheath made of metal.

12. A system further comprising:

first and second mutually parallel channels intersected by a horizontal plane;

a first beam having a longitudinal axis extending generally parallel to said horizontal plane;

a rigid frame for fixedly supporting said first beam relative to said first and second channels, and said first and second channels relative to each other; and a plurality of outboard motors secured to said first beam.

13. The system as recited in claim 12, further comprising third and fourth mutually parallel channels intersected by said horizontal plane, wherein said first and second channels are separated by a predetermined distance, and said third and fourth channels are separated by said predetermined distance.

14. The system as recited in claim 12, further comprising a second beam having a longitudinal axis extending generally parallel to said horizontal plane, wherein said rigid frame fixedly supports said second beam relative to said first and second channels, and relative to said first beam.

15. A outboard motor rack system comprising:

a substantially planar base portion comprising a first pair of parallel lift tubes having opposite open ends, a second pair of parallel lift tubes having opposite open ends, perpendicular to and intersecting with said first pair of lift tubes such that said first and second pairs of lift tubes together form a grid pattern, and peripheral supports connecting adjacent ones of said open ends of said lift tubes along a periphery;

first and second support frames extending upward from said peripheral supports;

first and second beams respectively supported by said first and second support frames, each of said first and second beams being designed to receive a plurality of outboard motors thereon; and a parts storage container having a removable lid, said parts storage container being affixed to said base portion.

16. A outboard motor rack system comprising:

a substantially planar base portion comprising a first pair of parallel lift tubes having opposite open ends, a second pair of parallel lift tubes having opposite open ends, perpendicular to and intersecting with said first pair of lift tubes such that said first and second pairs of lift tubes together form a grid pattern, and peripheral supports connecting adjacent ones of said open ends of said lift tubes along a periphery;

first and second support frames extending upward from said peripheral supports;

first and second beams respectively supported by said first and second support frames, each of said first and second beams being designed to receive a plurality of outboard motors thereon; and first and second pluralities of outboard motors respectively mounted to said first and second beams.

17. A method comprising the steps of:

placing a rack on a solid stationary substrate at a point of origin;

securing a plurality of outboard motors to said rack in a manner so that said outboard motors are supported only by said rack; and transporting said rack with said plurality of outboard motors secured thereto from said point of origin to a destination.

18. The method as recited in claim 17, further comprising the steps of:

removing said outboard motors from said rack at said destination; and transporting said rack without outboard motors mounted thereon from said destination to said point of origin.

19. The method as recited in claim 17, further comprising the step of placing said rack with said plurality of outboard motors mounted thereon inside a carrier vehicle, said transporting step comprising the step of moving said carrier vehicle from said point of origin to said destination.

20. The method as recited in claim 17, wherein the number of outboard motors of said plurality equals at least four.

21. The method as recited in claim 17, wherein said rack has a plane of symmetry, and said securing step comprising the steps of securing first and second outboard motors to said rack, said first and second outboard motors being arranged on opposite sides of said plane of symmetry in substantially mirror relationship.

22. An outboard motor rack system comprising:

a generally horizontal four-sided base comprising a first pair of mutually parallel channels for receiving forklift tines;

a support frame extending upward from said base;

first and second motor mounting members supported by said support frame; and first and second outboard motors mounted to said first and second motor mounting members respectively.

23. The system as recited in claim 22, wherein said base further comprises a second pair of mutually parallel channels for receiving forklift tines, said second pair being generally orthogonal relative to said first pair of mutually parallel channels.

24. The system as recited in claim 22, further comprising third and fourth outboard motors mounted to said first and second motor mounting members respectively.

* * * * *

UNITED STATES PATENT AND TRADEMARK OFFICE

CERTIFICATE OF CORRECTION

PATENT NO. : 6,585,224 B1
DATED : July 1, 2003
INVENTOR(S) : Jesse R. Schmidt

It is certified that error appears in the above-identified patent and that said Letters Patent is hereby corrected as shown below:

Column 2,
Line 32, delete “The channels for each pair are”;
Lines 33 and 34, delete the entire line;
Line 35, delete “can be”.

Signed and Sealed this

Twenty-seventh Day of April, 2004

JON W. DUDAS
*Acting Director of the United States Patent and Trademark Office*